US008687999B2

(12) United States Patent
Okano et al.

(10) Patent No.: US 8,687,999 B2
(45) Date of Patent: Apr. 1, 2014

(54) COOLING DEVICE AND IMAGE FORMING APPARATUS

(75) Inventors: Satoshi Okano, Kanagawa (JP); Kenichi Takehara, Kanagawa (JP); Yasuaki Iijima, Kanagawa (JP); Hiromitsu Fujiya, Kanagawa (JP); Keisuke Yuasa, Kanagawa (JP); Tomoyasu Hirasawa, Kanagawa (JP); Masanori Saitoh, Tokyo (JP); Shingo Suzuki, Kanagawa (JP); Keisuke Ikeda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 258 days.

(21) Appl. No.: 13/137,617

(22) Filed: Aug. 30, 2011

(65) Prior Publication Data

US 2012/0061057 A1 Mar. 15, 2012

(30) Foreign Application Priority Data

Sep. 9, 2010 (JP) ..... 2010-201924

(51) Int. Cl.
*G03G 21/20* (2006.01)

(52) U.S. Cl.
USPC ..... 399/94

(58) Field of Classification Search
USPC ..... 399/94, 110, 107
See application file for complete search history.

(56) References Cited

U.S. PATENT DOCUMENTS

2008/0247432 A1 10/2008 Miyajima et al.
2010/0008694 A1 1/2010 Okano et al.
2010/0008695 A1 1/2010 Okano et al.
2010/0129107 A1 5/2010 Takehara et al.
2010/0183323 A1 7/2010 Fujiya et al.
2011/0030927 A1 2/2011 Okano et al.
2011/0052247 A1 3/2011 Saitoh et al.
2011/0052248 A1 3/2011 Nishimura et al.
2011/0052249 A1 3/2011 Iijima et al.
2011/0164896 A1 7/2011 Hirasawa et al.
2011/0170895 A1 7/2011 Fujiya et al.
2011/0188880 A1 8/2011 Suzuki et al.

FOREIGN PATENT DOCUMENTS

JP 2000-307284 11/2000
JP 2007024985 A 2/2007

OTHER PUBLICATIONS

Machine translation of Naito, JP 2000-307284.*
Bimetallic Corrosion, National Physical Laboratory (2000).*
European Search Report dated Dec. 14, 2011 issued in corresponding European Application No. 11180439.9.

* cited by examiner

*Primary Examiner* — David Gray
*Assistant Examiner* — Sevan A Aydin
(74) *Attorney, Agent, or Firm* — Harness, Dickey & Pierce, PLC

(57) ABSTRACT

A liquid-cooling-type cooling device includes a circulatory path for coolant that cools a temperature rise portion; a heat absorbing unit that absorbs a heat from the temperature rise portion by the coolant; a heat radiating unit that radiate the heat from the coolant; a pump that circulates the coolant; and a plurality of liquid-contacting metal portions that comes into contact with the coolant, each of the liquid-contacting metal portions being made of a metal material. At least one of the liquid-contacting metal portions is grounded.

6 Claims, 7 Drawing Sheets

FIG.13

| METAL | STANDARD ELECTRODE POTENTIAL (V) | IONIZATION TENDENCY |
|---|---|---|
| Al | -1.68 | HIGH |
| Zn | -0.76 | ↑ |
| Fe | -0.44 | ↑ |
| Ni | -0.26 | ↑ |
| Sn | -0.14 | ↑ |
| Pb | -0.13 | ↑ |
| H | 0.00 | ↑ |
| Cu | 0.34 | ↑ |
| Ag | 0.80 | ↑ |
| Au | 1.52 | LOW |

COOLING DEVICE AND IMAGE FORMING APPARATUS

CROSS-REFERENCE TO RELATED APPLICATIONS

The present application claims priority to and incorporates by reference the entire contents of Japanese Patent Application No. 2010-201924 filed in Japan on Sep. 9, 2010.

BACKGROUND OF THE INVENTION

1. Field of the Invention

The present invention is directed generally to a liquid-cooling-type cooling device that uses coolant, and an image forming apparatus including the cooling device.

2. Description of the Related Art

Image forming apparatuses, such as a copying apparatus, a printing apparatus, a facsimile apparatus, or a multifunction peripheral having two or more functions of these apparatuses, have adopted various methods as a method for recording an image of a text, a symbol, and/or the like on a recording medium, such as paper or an overhead transparency film. Widely used among the methods is an electrophotographic method because it enables formation of fine-resolution images at high speeds. Generally, an image forming process performed by an electrophotographic image forming apparatus includes a step of obtaining image information by scanning with an optical device; a step of writing an electrostatic latent image on a photosensitive element based on the scanned image information; a step of forming a toner image on the photosensitive element with toner supplied from a developing device; a step of transferring the toner image formed on the photosensitive element onto a recording medium; and a step of fixing the transferred toner image onto the recording medium.

Meanwhile, it is known that, during the image forming process, heat produced by operations of various devices in the image forming apparatus increases the temperature in the apparatus and yields various detriments. For instance, in the optical device, a scanner lamp for scanning a document and a scanner motor that drives the scanner lamp produce heat; in a writing device, a motor that rotates a polygon mirror at a high speed produces heat. In the developing device, frictional heat is produced when the toner is agitated to be charged; in a fixing device, a heater that thermally fixes the toner image produces heat. When duplex printing is to be performed, a recording medium heated by the fixing device is sent to a conveying path for duplex printing; accordingly, the temperature around the conveyance path increases. When the temperature in the apparatus is increased by these heats, toner softening that can result in production of a poor-quality image or solidification of melted toner that can cause a movable part in the developing device to be locked, thereby causing a breakdown, can occur. A temperature rise can also result in problems including degradation in oil on a bearing and the like, reduction in mechanical useful life of a motor, malfunction of an integrated circuit (IC) on a circuit board, a breakdown, and deformation of a resin part of low heat resistance temperature. Conventionally, to prevent such detriments as discussed above resulting from a temperature rise in an image forming apparatus, cooling has been performed with an air-cooling-type cooling device using a cooling fan, a duct, and the like.

However, in recent years, the number of heat producing members provided in an image forming apparatus has increased with speedup of processes, such as printing. Furthermore, to achieve more compact design, packaging density of components in an image forming apparatus is increasing. This increase in packaging density makes it difficult to optimize airflow design in the image forming apparatus; therefore, heat is likely to be trapped inside the image forming apparatus. Furthermore, in response to the request for energy saving, toners having lower fusing temperatures have been developed to reduce energy consumption during image fixing. When, in particular, such a toner having a lower fusing temperature is used, reducing a temperature rise in an image forming apparatus is ever-more needed. For these reasons, obtaining sufficient cooling effect with a conventional air-cooling-type cooling device is becoming increasingly difficult. Because of this, a cooling device adopting, as a cooling method of a higher cooling capacity, a liquid cooling method has been proposed (see Japanese Patent Application Laid-open No. 2007-24985, for example).

FIG. 12 illustrates the configuration of a general liquid-cooling-type cooling device.

As shown in FIG. 12, a liquid-cooling-type cooling device 900 includes a heat absorbing unit 310 attached to a heat generating portion, or a temperature rise portion 300, a pump 320, a radiator 330, a fan 340, a reservoir tank 350, and piping 360. The piping 360 connects these components and circulates coolant therethrough. The pump 320 circulates the coolant between the heat absorbing unit 310 and the radiator 330 to thereby radiate heat absorbed at the heat absorbing unit 310 through the radiator 330. Moreover, the fan 340 sends an air flow onto the radiator 330, thereby forcibly lowering the temperature of the coolant flowing through the radiator 330. Unlike an air-cooling system, a liquid-cooling system carries heat using liquid refrigerant (coolant) that has a large heat capacity as compared with air; accordingly, a liquid-cooling system has a large heat absorption capacity and is capable of cooling the heat generating portion, or the temperature rise portion 300, effectively.

Generally, copper or aluminum having a high heat conductivity is used as a material of the heat absorbing unit 310 so that the heat absorbing unit 310 has a heat absorption capacity as large as possible. For instance, the heat absorbing unit 310 may be an aluminum or copper block inside which a channel is defined, a member formed by brazing an aluminum pipe to an aluminum plate, or a member formed by connecting a copper pipe to a pipe-like aluminum block with a method, such as diameter expanding and caulking.

Copper or aluminum is also used as a material of the radiator 330 for a similar reason. For instance, the radiator 330 may be constructed by connecting a tube of aluminum, copper, or stainless steel to a corrugated fin of aluminum, copper or stainless steel by brazing or the like.

The piping 360 includes metal pipes and tubes of rubber or resin. Metal pipes are favorable in a point that metal pipes allow reducing evaporation of coolant as compared in a case with tubes of rubber or resin. However, metal pipes cannot be readily bended and are hard to be assembled into devices. For this reason, flexible tubes of rubber or resin are partially used to ensure easy assembling. Meanwhile, when tubes of rubber or resin are to be used, desirably selected are tubes of a material and shape that minimize moisture evaporation and that release a small amount of halogen to prevent corrosion of metal portions contacting the coolant.

As described above, metal materials are used in a heat absorbing unit, a radiator, and the like of a cooling device. In a case in which metal portions of them are made of dissimilar metal materials, what is called galvanic corrosion can occur. Galvanic corrosion is a phenomenon in which, when dissimilar metals in electrical contact are immersed in an electrolytic solution, a difference in ionization tendency between the dissimilar metals based on the standard electrode potentials shown in FIG. 13 develops a potential between the metals in a manner that a noble one (having a lower ion tendency) of the metals acts as a cathode and a base one (having a higher ionization tendency) of the metals acts as an anode; as a result, the base metal of the anode is ionized to become metallic ions and solved in the electrolytic solution, to thus be corroded. Meanwhile, the greater the potential difference between the different kinds of metal materials, the greater the magnitude of an electric current, by which corrosion is promoted.

For instance, in a cooling device including a heat absorbing unit made of a copper block and an aluminum radiator of a corrugated fin type, if the heat absorbing unit and the radiator are electrically connected, an electron conducting pathway is formed therebetween. Meanwhile, coolant is typically an electrolytic solution containing conductive rust inhibiter. Accordingly, an ion conducting pathway is formed via the coolant between the heat absorbing unit and the radiator. For this reason, either one of the metal portions of the heat absorbing unit or the radiator which contact the coolant acts as a cathode, while the other one acts as an anode. Thereby, a galvanic corrosion occurs in which the anode side (the radiator side in this case) elutes into the coolant as metal ion. If the coolant leaks from a corroded part, failure to provide necessary cooling occurs, which can result in production of an anomalous image resulting from a temperature rise. Furthermore, adhesion of leaked coolant to a device, such as an image forming device, can degrade image quality.

Methods of preventing the galvanic corrosion include a method of using a same kind of metal materials to form the metal portions. However, generally, copper is used in the heat absorbing unit to increase cooling capacity, while aluminum is used in the radiator in view of lower cost in many cases; therefore, it is not necessarily possible to select a same kind of metal material in view of performance and cost.

Another conceivable method is to electrically insulate the metal portions from each other to prevent galvanic corrosion. However, in the presence of insulated metal portions, static electricity is likely to build up on the insulated metal portions; therefore, static electricity undesirably builds up on the metal portions in some cases. Examples of a charging unit that electrostatically charges a photosensitive element include: a corona discharge-type charging unit that causes corona discharge by applying a high voltage to a thin metal wire and directs the generated ions onto a surface of a photosensitive element, thereby charging the photosensitive element. Examples further include a charging method of a proximate discharge type in which voltage is applied by bringing a discharge roller having a moderate resistance in contact with or close to the photosensitive element so that the discharge occurs in the vicinity of the contact point or the close point. In particular, in a case of using a charging unit of a corona discharge type or a proximate discharge type as the charging unit that charges a photosensitive element, ions generated from the charging unit are suspended around an image forming device. Therefore, static electricity builds up on the insulated metal portions. The electrostatic charge on the metal portions can exert a negative influence on an image. Moreover, if the amount of electrostatic charge is large, discharge can occur, which poses a problem in terms of safety.

SUMMARY OF THE INVENTION

It is an object of the present invention to at least partially solve the problems in the conventional technology.

According to an aspect of the present invention, there is provided a liquid-cooling-type cooling device includes: a circulatory path for coolant that cools a temperature rise portion; a heat absorbing unit that absorbs a heat from the temperature rise portion by the coolant; a heat radiating unit that radiate the heat from the coolant; a pump that circulates the coolant; and a plurality of liquid-contacting metal portions that comes into contact with the coolant, each of the liquid-contacting metal portions being made of a metal material. At least one of the liquid-contacting metal portions is grounded.

According to an aspect of the present invention, there is provided an image forming apparatus includes the cooling device described above.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 13 is a diagram illustrating difference in ionization tendency based on standard electrode potentials of various types of metals.

DETAILED DESCRIPTION OF THE PREFERRED EMBODIMENTS

Figure 1:
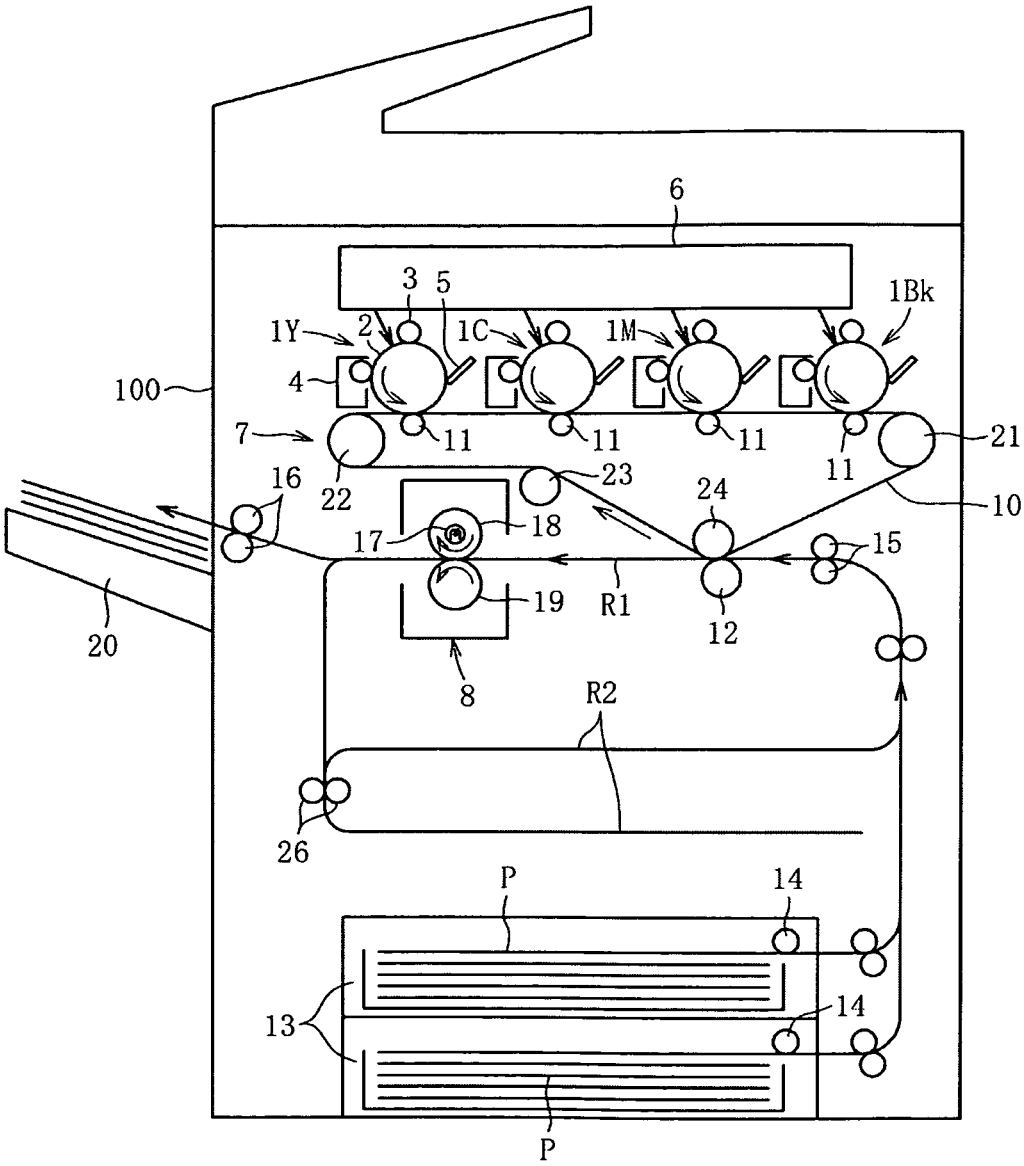
FIG. 1 is a schematic configuration diagram of a color image forming apparatus according to the present invention.

Exemplary embodiments of the present invention will be described below with reference to the drawings. Note that in the drawings, identical or equivalent parts are denoted by like reference numerals, and repeated descriptions are simplified or omitted appropriately.

FIG. 1 is a schematic configuration diagram of a color image forming apparatus according to the present invention.

The image forming apparatus shown in FIG. 1 includes a tandem image forming device, in which four process units, serving as an image forming unit, 1Y, 1C, 1M, and 1Bk are aligned. The process units 1Y, 1C, 1M, and 1Bk are configured to be detachable from an image forming apparatus body 100 and similar to one, another in configuration except that the process units 1Y, 1C, 1M, and 1Bk contain toner of different colors, which are yellow (Y), cyan (C), magenta (M), and black (Bk), that correspond to color separation components, into which a color image is to be color-separated.

More specifically, each of the process units 1Y, 1C, 1M, and 1Bk includes a drum-like photosensitive element 2 serving as a latent image carrier, a charging roller 3 serving as a charging unit that charges a surface of the photosensitive element 2, a developing device 4 serving as a developing unit that forms a toner image on the surface of the photosensitive element 2, and a cleaning blade 5 serving as a cleaning unit that cleans the surface of the photosensitive element 2. Note that, in FIG. 1, only the photosensitive element 2, the charging roller 3, the developing devices 4, and the cleaning blade 5 provided in the process unit 1Y for yellow are indicated by reference numerals, while reference numerals for those of the other process units 10, 1M, and 1Bk are omitted.

In FIG. 1, an exposing device 6 serving as an exposing unit is arranged above each of the process units 1Y, 1C, 1M, and 1Bk. The exposing device 6 that includes a light source, a polygon mirror, and an fθ lens is configured to emit laser light onto the surface of the photosensitive element 2 according to image data.

Meanwhile, a transfer device 7 is arranged below the process units 1Y, 1C, 1M, and 1Bk. The transfer device 7 includes an intermediate transfer belt 10, which includes an endless belt, serving as a transfer element. The intermediate transfer belt 10 is wound around and supported by a plurality of rollers 21 to 24, which serve as support members, in a tensioned manner. The intermediate transfer belt 10 is configured to go around (rotate) in a direction indicated by an arrow in FIG. 1 by rotation of one of the rollers 21 to 24 serving as a driving roller.

Four primary transfer rollers 11 serving as a primary transfer unit are arranged at positions facing the four photosensitive elements 2. Each of the primary transfer rollers 11 presses against an inner peripheral surface of the intermediate transfer belt 10 at a corresponding one of the positions. Thus, primary transfer nips are formed at contacts between parts, at which the intermediate transfer belt 10 is pressed, of the intermediate transfer belt 10 and the photosensitive elements 2. Each of the primary transfer rollers 11 is connected to a power source (not shown), from which a predetermined direct-current (DC) voltage and/or an alternating-current (AC) voltage is applied to the primary transfer roller 11.

Meanwhile, a secondary transfer roller 12 serving as a secondary transfer unit is arranged at a position facing the roller 24, which is one of the rollers, on which the intermediate transfer belt 10 is supported in the tensioned manner. The secondary transfer roller 12 presses against an outer peripheral surface of the intermediate transfer belt 10, thereby forming a secondary transfer nip at a contact between the secondary transfer roller 12 and the intermediate transfer belt 10. Similarly to the primary transfer rollers 11, the secondary transfer roller 12 is connected to the power source (not shown), from which a predetermined DC voltage and/or an AC voltage is applied to the secondary transfer roller 12.

A plurality of paper cassettes 13 that accommodates sheet-shaped recording medium P, such as paper or an overhead transparency film, is arranged in a lower part of the image forming apparatus body 100. A paper feed roller 14 that conveys out the accommodated recording medium P is provided at each of the paper cassettes 13. Furthermore, a discharge tray 20, on which the recording medium P having been discharged out of the apparatus is to be stacked, is provided on an outer surface, on the left side in FIG. 1, of the image forming apparatus body 100.

A conveying path R1 for conveying the recording medium P from the paper cassette 13 via the secondary transfer nip to the discharge tray 20 is provided in the image forming apparatus body 100. Registration rollers 15 are arranged at a position upstream, in a recording-medium conveying direction, from the secondary transfer nip on the conveying path R1. A fixing device 8 is arranged further downstream in the recording-medium conveying direction from the position of the secondary transfer roller 12. A pair of discharging rollers 16 is arranged further downstream therefrom in the conveying direction. The fixing device 8 includes: for instance, a fixing roller 18 that serves as a fixing member and internally includes a heater 17; and a pressing roller 19 that serves as a pressing member and applies a pressure to the fixing roller 18. A fixing nip is formed at a contact between the fixing roller 18 and the pressing roller 19.

Furthermore, a reverse path R2 for, when duplex printing is to be performed, supplying the recording medium P turned top side down is arranged in the image forming apparatus body 100. The reverse path R2 is branched out from the conveying path R1 at a position between the fixing device 8 and the discharging rollers 16 and joins to the conveying path R1 at a position upstream from the registration rollers 15. On the reverse pat R2, switchback rollers 26 that rotate forward and in reverse are provided.

Basic operation of the image forming apparatus will be described below with reference to FIG. 1.

When an image forming operation is started, the photosensitive elements 2 of the process units 1Y, 1C, 1M, and 1Bk are rotated counterclockwise in FIG. 1. And, the surface of each of the photosensitive elements 2 is uniformly charged by the charging roller 3 in a predetermined polarity. The exposing device 6 emits a laser beam onto the charged surface of the photosensitive elements 2 according to image information obtained from a scanning device (not shown) by scanning a document. Thus, an electrostatic latent image is formed on the surface of each of the photosensitive elements 2. At this time, the image information, according to which exposure of the photosensitive elements 2 is to be performed, is mono-color image information obtained by separating a desired full-color image into color information of yellow, cyan, magenta, and black. Toner is supplied from the developing devices 4 to the electrostatic latent images thus formed on the photosensitive elements 2; hence, the electrostatic latent images are developed into toner images (visible images).

One of the rollers, on which the intermediate transfer belt 10 is supported in the tensioned manner, rotates, thereby causing the intermediate transfer belt 10 to go around in the direction indicated by the arrow in FIG. 1. Furthermore, by application of a voltage having undergone constant voltage control or constant current control and of a reversed polarity to the polarity of the toner is applied to each of the primary transfer rollers 11, a transfer electric field is formed at the primary transfer nip between each of the primary transfer rollers 11 and each of the photosensitive elements 2. The toner images of the colors formed on the photosensitive elements 2 are then sequentially transferred onto the intermediate transfer belt 10 by the transfer electric field formed at the primary transfer nips to be overlaid on one another. Thus, the intermediate transfer belt 10 carries a full-color toner image on its surface. The toner on each of the photosensitive elements 2 that has not been transferred onto the intermediate transfer belt 10 is removed by the cleaning blade 5.

As the paper-supplying roller 14 rotates, the recording medium P is conveyed out from the paper cassette 13. The conveyed-out recording medium P is fed to the secondary transfer nip between the secondary transfer roller 12 and the intermediate transfer belt 10 by the registration rollers 15 in a timed manner. At this time, a transfer voltage of a reversed polarity to the polarity of the charge of the toner of the toner image on the intermediate transfer belt 10 is applied to the secondary transfer roller 12; accordingly, a transfer electric field is formed at the secondary transfer nip. Then, the toner images on the intermediate transfer belt 10 are transferred onto the recording medium P at one time because of the transfer electric field formed at the secondary transfer nip. Thereafter, the recording medium P is conveyed into the fixing device 8 where the recording medium P receives, from the fixing roller 18 and the pressing roller 19, heat and pressure that fix the toner images onto the recording medium P. The recording medium P is then discharged onto the discharge tray 20 by the pair of discharging rollers 16.

Meanwhile, when duplex printing is to be performed, the recording medium P, on one surface (front surface) of which the image has been fixed, is conveyed to the reverse path R2 rather than discharged onto the discharge tray 20. On the reverse path R2, the switchback rollers 26 rotate in reverse, by which the recording medium P is conveyed in a reverse direction and sent to the conveying path R1 again. This is generally referred to as a switch-back motion; the recording medium P is turned top side down by this motion.

The recording medium P turned top side down is conveyed to the secondary transfer nip, at which an image is transferred onto the back surface of the recording medium P as is the case where the image has been transferred onto the one surface. After the image has been fixed onto the back surface of the recording medium P by the fixing device 8, the recording medium P is discharged onto the discharge tray 20.

Although image formation for forming a full-color image on a recording medium has been described above, it is also possible to form a mono-color image using one of the four process units, or, more specifically, the process units 1Y, 1C, 1M, and 1Bk, to form a two-color or three-color image using two or three of the process units.

Figure 2:
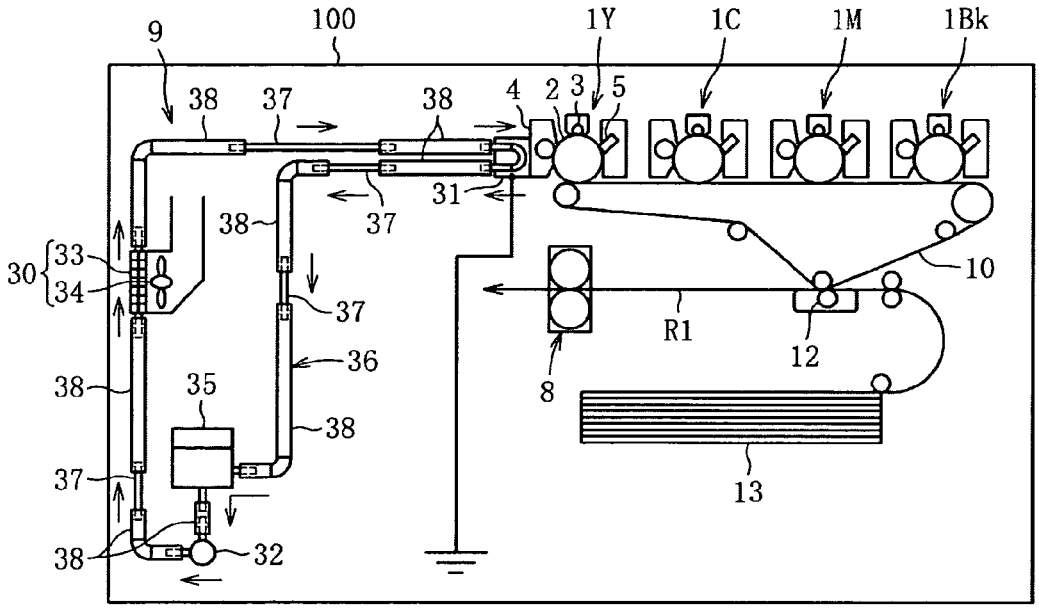
FIG. 2 is a schematic diagram illustrating the configuration according to a first embodiment of the present invention.

FIG. 2 is a schematic diagram illustrating the configuration of a characteristic feature according to a first embodiment of the present invention.

As shown in FIG. 2, a cooling device 9 for cooling a temperature rise portion in the image forming apparatus is provided in the image forming apparatus body 100. This cooling device 9, which is a liquid-cooling-type cooling device, includes a heat absorbing unit 31, a heat radiating unit 30, a pump 32, and a tank 35, and piping 36 that connects these components and forms a circulatory path, through which coolant circulates. The piping 36 includes a plurality of metal pipes 37 and a plurality of resin tubes 38. As the coolant, antifreeze containing rust preventive is used.

Examples of a portion to be cooled, or the temperature rise portion, in the image forming apparatus include the scanning device (not shown), the photosensitive elements 2, the developing devices 4, the fixing device 8, and toner. Description will be directed to the developing device 4 of the process unit 1Y for yellow that is arranged at a leftmost position in FIG. 2. The heat absorbing unit 31 is located in contact with this developing device 4.

In the developing device 4, frictional heat is generated by toner agitation performed to triboelectrically charge the toner when image formation is performed. At this time, the heat generated in the developing device 4 is transmitted to the inner coolant via the heat absorbing unit 31. The pump 32 sends the coolant from the heat absorbing unit 31 through the piping 36 to a radiator 33 arranged in the heat radiating unit 30. In the radiator 33, heat radiates from the coolant. Meanwhile, a fan 34 is provided in the heat radiating unit 30. Air flow supplied from the fan 34 to the radiator 33 forcibly cool the coolant flowing through the radiator 33. In this way, the coolant is circulated between the heat absorbing unit 31 and the heat radiating unit 30 to repeat cycles of heat absorption and heat radiation; thus, the temperature rise in the developing device 4 is reduced. This prevents toner fusing and toner adhesion in the developing device 4, thereby preventing production of an anomalous image. The tank 35 temporarily stores the coolant from the radiator 33 to prevent great pressure changes in the piping 36.

In the first embodiment, each of the heat absorbing unit 31, the pump 32, and the radiator 33 is made of a metal material. Each of these components and the metal pipes 37 includes a portion (hereinafter, "liquid-contacting metal portion") that is made of a metal material of its own and comes into contact with the coolant. The liquid-contacting metal portions are electrically insulated from one another. Examples of an insulation method include a method of mounting the pump 32, the radiator 33, and each of the metal pipes 37 to a housing via a resin bracket. Meanwhile, each of the resin tubes 38 serves as an insulator. Moreover, in the first embodiment, the heat absorbing unit 31 is grounded.

In the first embodiment configured as described above, even in a case that the heat absorbing unit 31, the pump 32, the radiator 33, and the metal pipes 37 are made of different kinds of metal materials, an electric current flow and hence galvanic corrosion are not induced in spite of the difference in standard electrode potential of the different kinds of metal materials, since the liquid-contacting metal portions are electrically insulated from one another. Thus, leakage of the coolant caused by corrosion of a liquid-contacting metal portion can be prevented, allowing cooling capacity to be maintained over an extended period of time. Furthermore, degradation in image quality resulting from adhesion of leaked coolant to a device, such as an image forming device, is also prevented.

In the first embodiment, although the heat absorbing unit 31 is arranged in the vicinity of the image forming device and therefore exposed to static electricity generated by the charging roller or the like; however, static electricity will not build up on the heat absorbing unit 31, since the heat absorbing unit 31 is grounded. Thus, negative influences (e.g., jumbling of an electrostatic latent image on a photosensitive element caused by electrical noise produced by the electrostatic charge) on an image, malfunction of an electrical component, and the like resulting from electrostatic charge on the heat absorbing unit 31 can be prevented.

Figure 3:
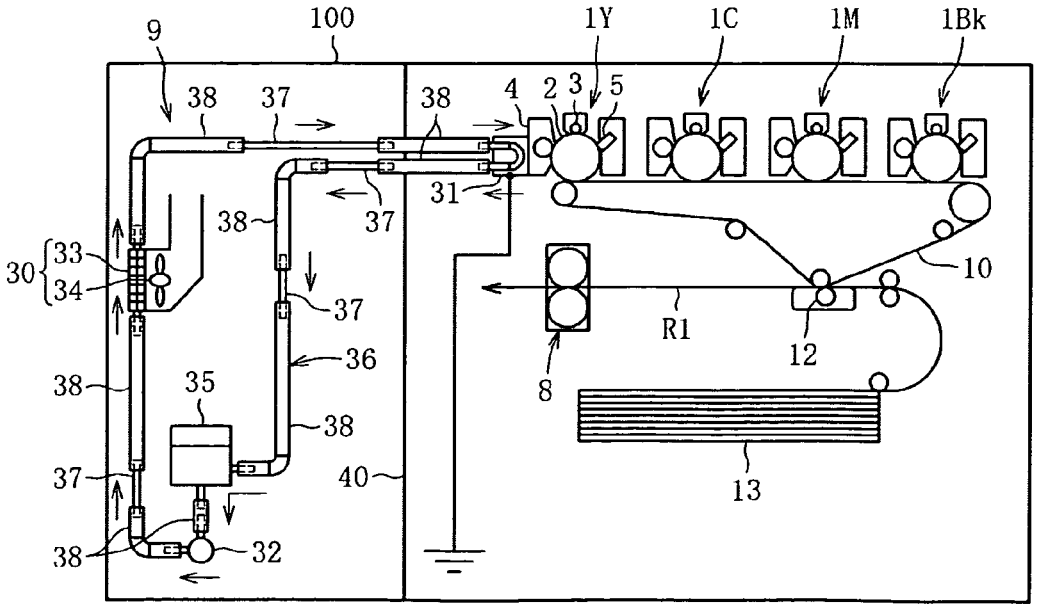
FIG. 3 is a schematic diagram illustrating the configuration according to a second embodiment of the present invention.

FIG. 3 is a schematic diagram illustrating the configuration of a second embodiment of the present invention.

The second embodiment shown in FIG. 3 includes, in addition to the configuration of the first embodiment shown in FIG. 2, a conductive shielding member 40 that is arranged between an area in which the heat radiating unit 30, the pump 32, and the metal pipes 37 are disposed, and an area in which the process units 1Y, 1C, 1M, and 1Bk are disposed, the process units serving as the image forming device. The shielding member 40 is, for instance, a metal plate or the like.

The radiator 33, the pump 32, and the metal pipes 37 of the heat radiating unit 30 are insulated from each other but not grounded. Therefore, static electricity can build up on these components. For this reason, in the second embodiment, the conductive shielding member 40 is provided as described above so that, even in case that static electricity should build up on the radiator 33, the pump 32, the metal pipes 37 and electrical noise be emitted to the image forming device side, the shielding member 40 serves as a shield. Accordingly, a device or member, such as the image forming device, to be protected against an influence of the electrostatic charge is protected from the electrical noise, and hence production of an anomalous image can be prevented. Meanwhile, to prevent electrostatic charge on the shielding member 40 itself, the shielding member 40 is desirably grounded.

Figure 4:
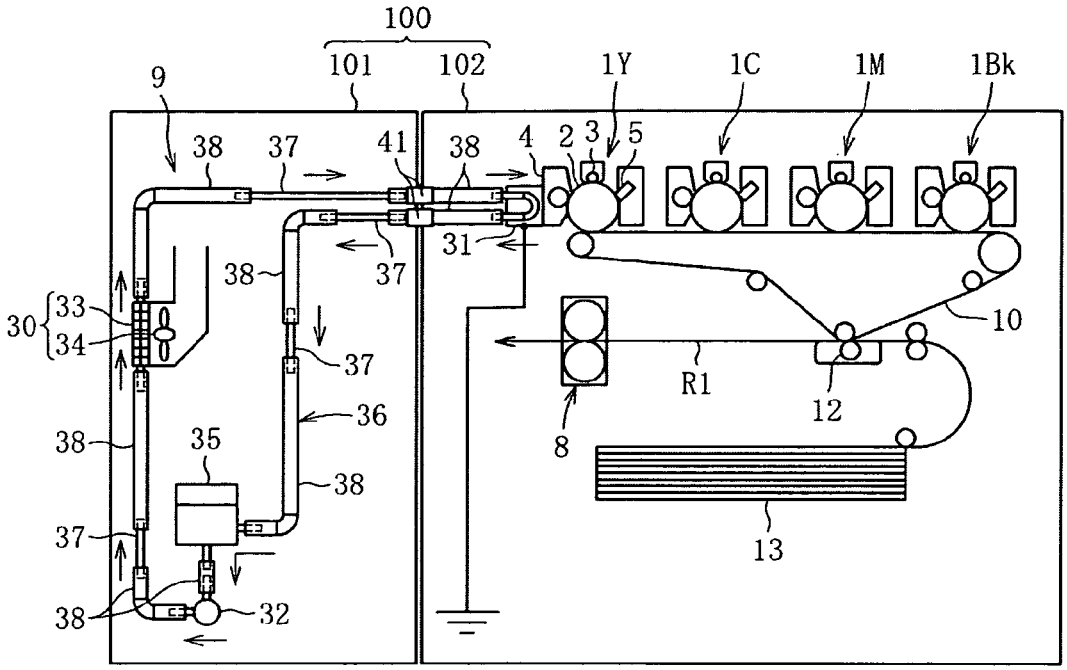
FIG. 4 is a schematic diagram illustrating the configuration according to a third embodiment of the present invention.

FIG. 4 is a schematic diagram illustrating the configuration of a third embodiment of the present invention.

In the third embodiment, instead of providing the shielding member 40 shown in FIG. 3, the image forming apparatus body 100 is divided into two housings, or, more specifically, a first housing 101 and a second housing 102; the radiator 33, the pump 32, the metal pipes 37, and the like are arranged in the first housing 101 (on the left-hand side in FIG. 4), which is one of the housings, while the process units 1Y, 1C, 1M, and 1Bk, and the like are arranged in the second housing 102 (on the right-hand side in FIG. 4), which is the other one. The third embodiment is basically similar to the second embodiment shown in FIG. 3 in configuration in other respects.

In the third embodiment, the radiator 33, the pump 32, and the metal pipes 37, and the process units 1Y, 1C, 1M, and 1Bk are arranged in the different housings 101 and 102. Accordingly, in case that static electricity should build up on the radiator 33, the pump 32, the metal pipes 37, side plates (which are generally made of metal) or the like of the housings 101 and 102 shield electrical noise emitted from the charged radiator 33 or the like. Furthermore, in this case, the charged component, such as the radiator 33, is isolated from the process units 1Y, 1C, 1M, and 1Bk also in terms of space because they are distant from each other. Accordingly, a larger reduction in an extent of a negative influence on the image forming device from electrical noise can be achieved than that of the configuration shown in FIG. 3 in which the conductive shielding member 40 is arranged.

Meanwhile, as in this embodiment, in a case that the image forming apparatus body 100 is configured to include the different housings 101 and 102, it is convenient to arrange the piping 36 to be splittable by disposing a joint 41 at a parting part of the piping 36 extending over or straddling both housings 101 and 102, so that the housing 101 and the housing 102 can be separated from each other. Furthermore, as for the joint 41, a member configured to include valves on both sides of the parting part to prevent coolant leakage from the parting part is desirably used. In a case in which the joint 41 includes a liquid-contacting metal portion, galvanic corrosion that would otherwise be caused by a potential difference between dissimilar metals can be prevented by insulating the liquid-contacting metal portion from other liquid-contacting metal portion(s). Moreover, in this case, the joint 41 is preferably arranged in the housing 101 where the radiator 33 and the like are arranged. This allows, even if static electricity should build up on the joint 41, lessening a negative influence on the image forming device from electrical noise as with the case described above. Meanwhile, in a case in which the joint 41 is made of resin or the like, the joint 41 may be provided in any one of the housings 101 and 102.

Figure 5:
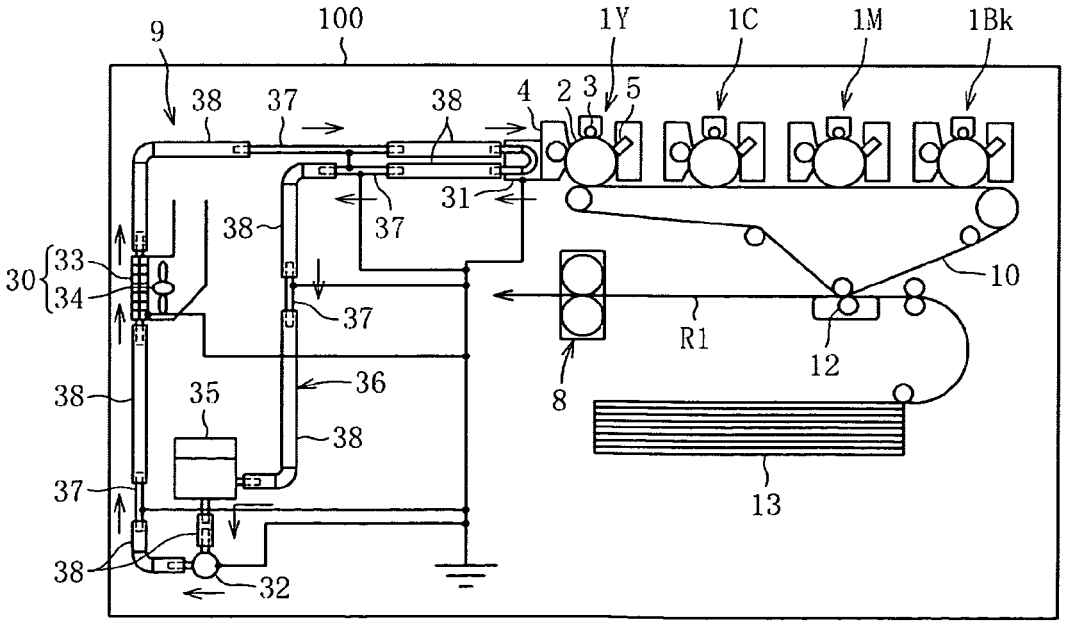
FIG. 5 is a schematic diagram illustrating the configuration according to a fourth embodiment of the present invention.

FIG. 5 is a schematic diagram illustrating the configuration of a fourth embodiment of the present invention.

As shown in FIG. 5, in the fourth embodiment, the heat absorbing unit 31, the radiator 33, the pump 32, and each of the metal pipes 37 are grounded. Therefore, static electricity will not build up on the heat absorbing unit 31, the radiator 33, the pump 32, and each of the metal pipes 37. Accordingly, a negative influence, malfunction of an electrical component, and the like resulting from electrostatic charge on these components can be prevented.

Note that grounding the heat absorbing unit 31, the radiator 33, the pump 32, and each of the metal pipes 37 places them in an electrically-connected state (state where an electron conducting pathway has been formed). For this reason, in the fourth embodiment, liquid-contacting metal portions of these components are made of a same kind of metal material. By this, there is no potential difference in standard electrode potential among the liquid-contacting metal portions. Therefore, galvanic corrosion is prevented. Thus, the fourth embodiment can prevent leakage of the coolant which may be caused by corrosion of the liquid-contacting metal portion. Therefore, the cooling capacity can be kept over an extended period of time. Furthermore, the degradation in image quality which may be caused by an adhesion of leaked coolant to a device, such as the image forming device, can be prevented. The fourth embodiment is similar to the first embodiment in the configuration except for the configuration described above, and repeated descriptions are omitted.

Figure 6:
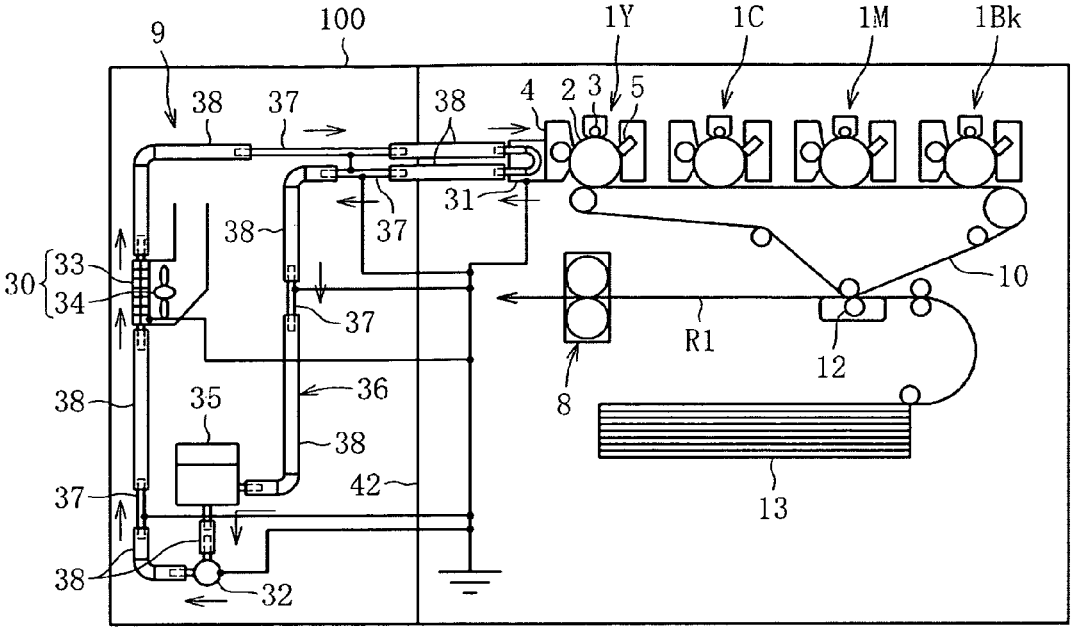
FIG. 6 is a schematic diagram illustrating the configuration according to a fifth embodiment of the present invention.

FIG. 6 is a schematic diagram illustrating the configuration of a fifth embodiment of the present invention.

The fifth embodiment shown in FIG. 6 includes, in addition to the configuration of the fourth embodiment shown in FIG. 5, a partition member 42 that is arranged between an area in which the heat radiating unit 30, the pump 32, and the metal pipes 37 are disposed, and an area in which the process units 1Y, 1C, 1M, and 1Bk are disposed. The heat absorbing unit 31, the radiator 33, the pump 32, and each of the metal pipes 37 are grounded. The liquid-contacting metal portion of the heat absorbing unit 31 is made of a metal material having an ionization tendency lower than that of each of the liquid-contacting metal portions of the radiator 33, the pump 32, and the metal pipes 37. In a case in which, for instance, copper (Cu) is selected as a metal material of the heat absorbing unit 31, aluminum (Al) or the like having a higher ionization tendency than that of copper (Cu) can be selected as a metal material of the radiator 33, the pump 32, and/or the metal pipes 37 (see FIG. 13).

In the fifth embodiment, as in the fourth embodiment, static electricity will not build up (i.e. there is no electrostatic charge) on the heat absorbing unit 31, the radiator 33, the pump 32, and each of the metal pipes 37 because these components are grounded. Accordingly, a negative influence, malfunction of an electrical component, and the like caused by electrical noise can be prevented. However, in the fifth embodiment, the heat absorbing unit 31, the radiator 33, the pump 32, and the metal pipes 37 are not made of a same kind of metal material. Accordingly, galvanic corrosion resulting from a potential difference between the different kinds of metal materials can occur. In this case, galvanic corrosion may occur in any one of the radiator 33, the pump 32, and the metal pipes 37, each of which is made of a metal material having a high ionization tendency. In contrast, galvanic corrosion will not occur in the heat absorbing unit 31 made of the metal material having a low ionization tendency. Thus, degradation in image quality resulting from liquid leakage from the heat absorbing unit 31 can be prevented. Furthermore, even in a case in which galvanic corrosion and coolant leakage occur in any one of the radiator 33, the pump 32, and the metal pipes 37, the partition member 42 prevents the leaked fluid from moving to the image forming device side. Accordingly, a device or member, such as the image forming device, that is to be protected against adhesion of the coolant can be protected. Thereby production of an anomalous image resulting from the fluid leakage can be prevented.

In this way, the fifth embodiment is configured to prevent galvanic corrosion in the heat absorbing unit 31 that is arranged in the vicinity of the image forming device by selecting the metal materials of the heat absorbing unit 31, the radiator 33, and the like with ionization tendency taken into consideration. Meanwhile, galvanic corrosion may occur in the radiator 33 and the like located away from the image forming device; however, even if galvanic corrosion occurs, it is possible to prevent a negative influence on the image forming device and the like not only because a location where the galvanic corrosion occurs is away from the image forming device but also because the partition member 42 that prevents moving of leaked fluid is provided. According to the configuration of the fifth embodiment, unlike the fourth embodiment shown in FIG. 5, it is not necessary to make the heat absorbing unit 31, the radiator 33, and the like of a same kind of metal material. Therefore, the degree of freedom in design is increased.

In a case in which liquid-contacting metal portions of the heat absorbing unit 31 are made of a plurality kinds of metal material, the radiator 33, the pump 32, and the metal pipes 37 are preferably made of a metal material(s) having ionization tendency higher than that of a metal material of which ionization tendency is highest among the metal materials of the heat absorbing unit 31. In this case, if liquid-contacting metal portions of the heat absorbing unit 31 made of the different kinds of metal materials are electrically connected, galvanic corrosion may occur. To prevent this, an insulator or the like is interposed between the liquid-contacting metal portions made of different metal materials, so that the electrically conductive pathway is not established.

Figure 7:
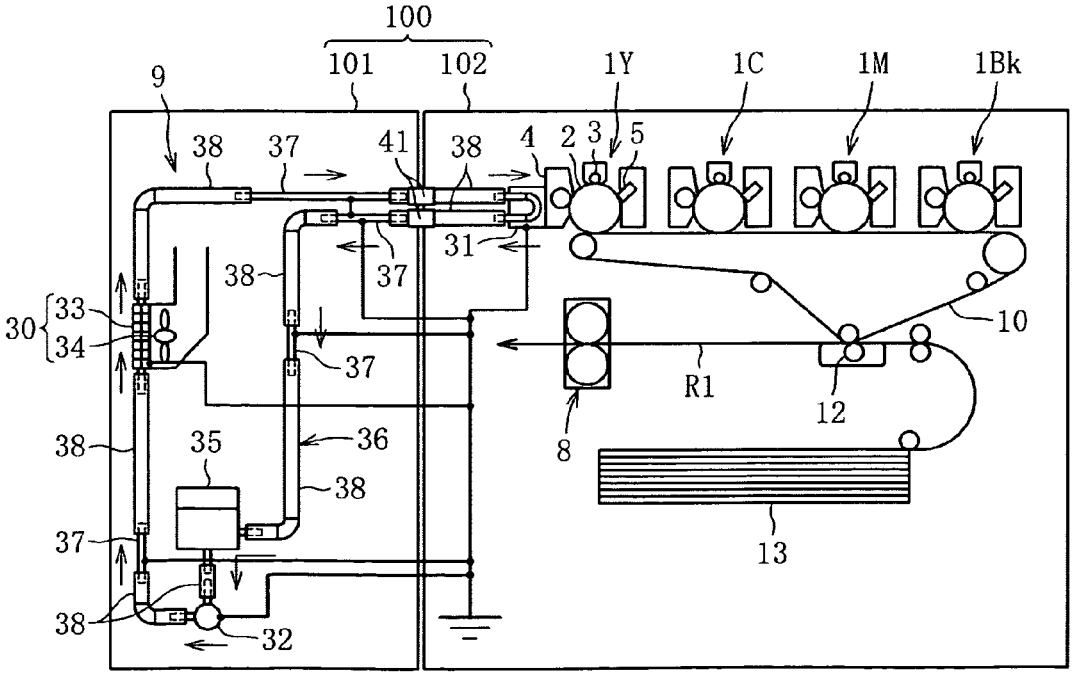
FIG. 7 is a schematic diagram illustrating the configuration according to a sixth embodiment of the present invention.

FIG. 7 is a schematic diagram illustrating the configuration of a sixth embodiment of the present invention.

In the sixth embodiment shown in FIG. 7, instead of providing the partition member 42 shown in FIG. 6, the image forming apparatus body 100 is divided into two housings, or, more specifically, the first housing 101 and the second housing 102. The first housing 101 (on the left-hand side in FIG. 7) accommodates therein the radiator 33, the pump 32, the metal pipes 37, and the like. The second housing 102 (on the right-hand side in FIG. 7) accommodates therein the process units 1Y, 1C, 1M, and 1Bk, and the like. The sixth embodiment is basically similar to the fifth embodiment shown in FIG. 6 in configuration in other respects.

According to the configuration of the sixth embodiment, the radiator 33 and the like are isolated from the process units 1Y, 1C, 1M, and 1Bk by the housings 101 and 102. Accordingly, even in case that galvanic corrosion and coolant leakage should occur in the radiator 33, the pump 32, or the metal pipes 37, leaked fluid is, prevented from moving to the image forming device side, and hence production of an anomalous image and the like resulting from fluid leakage can be prevented.

Meanwhile, also in the sixth embodiment, as in the third embodiment shown in FIG. 4, the piping 36 may be arranged to be splittable by disposing the joint 41 at a parting part of the piping 36 extending over or straddling both housings 101 and 102, so that the housings 101 and 102 can be separated from each other.

Figure 8:
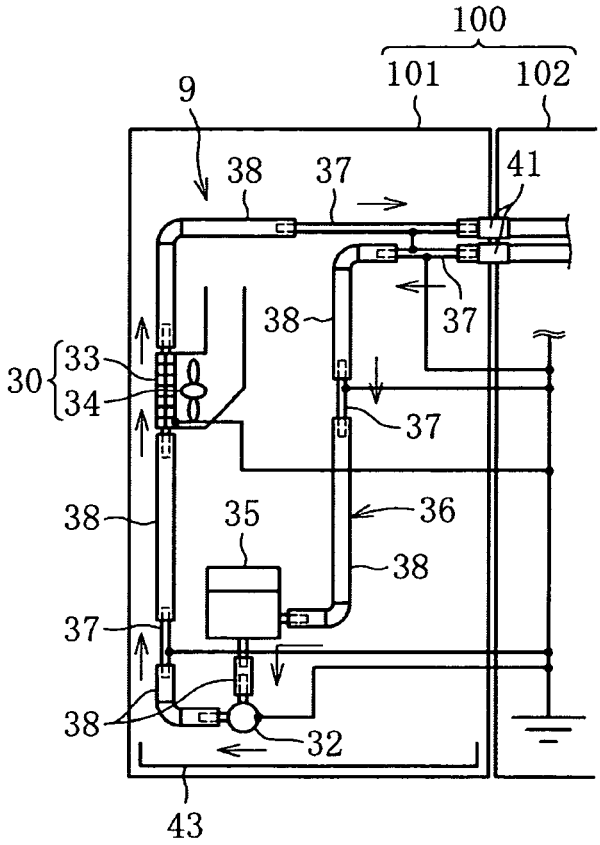
FIG. 8 is a schematic diagram of the configuration in which a waterproofing pan is provided.

Furthermore, as shown in FIG. 8, a waterproofing pan 43 serving as a leaked-fluid container that houses coolant leaked from the radiator 33, the pump 32, the metal pipes 37, and/or the like may be provided at a bottom part of the image forming apparatus body 100 (the first housing 101). This prevents intrusion of leaked fluid accumulated in the bottom part through a gap in the image forming apparatus body 100 into the image forming device side (the right-hand side in FIG. 8), thereby preventing a trouble, such as an anomalous image resulting from fluid leakage.

Figure 9:
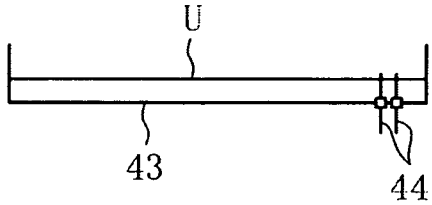
FIG. 9 is a schematic diagram of the configuration in which the waterproofing pan includes a sensor.

Furthermore, as shown in FIG. 9, a sensor 44 serving as a fluid-leak detector that detects leakage of the coolant may be provided at the waterproofing pan 43. As the sensor 44, for instance, a sensor that includes two electrode pins and measures the electrical resistance of coolant U can be used. By providing the sensor 44 in this way, fluid leakage is detected even at a small amount of leaked fluid. Accordingly, the leaked fluid can be prevented from intruding into the image forming device side, with increased reliability.

Figure 10:
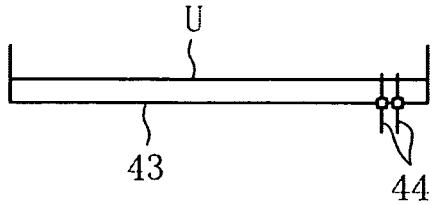
FIG. 10 is a schematic diagram of the configuration in which the waterproofing pan illustrated in FIG. 9 is tilted.

Moreover, as shown in FIG. 10, a configuration in which the waterproofing pan 43 is tilted and the sensor 44 is provided at an end portion on a lower side of the waterproofing pan 43 makes it possible to detect fluid leakage even at a still smaller amount of leaked fluid.

Figure 11:
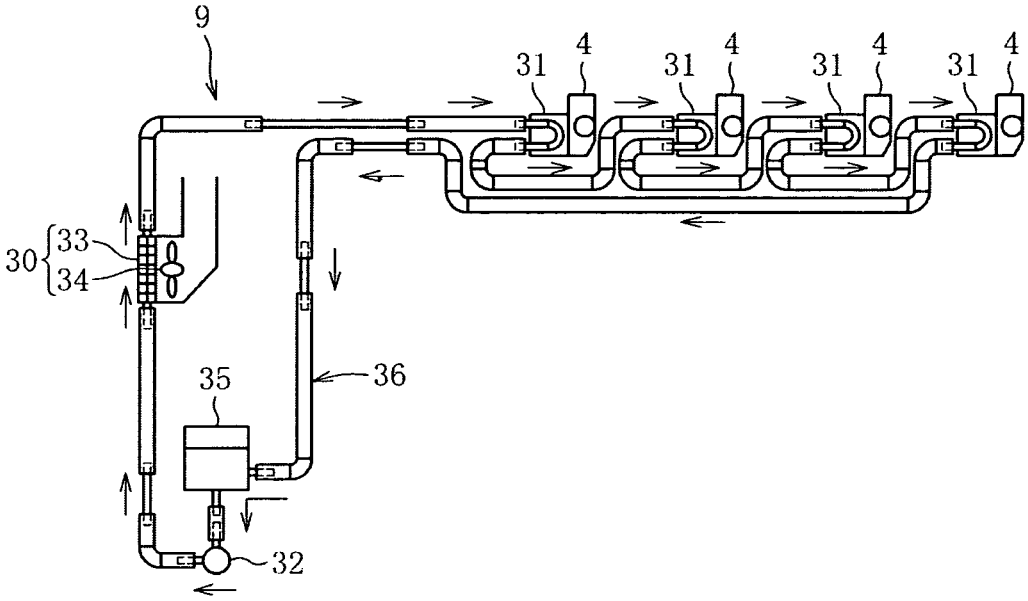
FIG. 11 is a schematic diagram of the configuration in which a heat absorbing unit is provided in each of developing devices.
Figure 12:
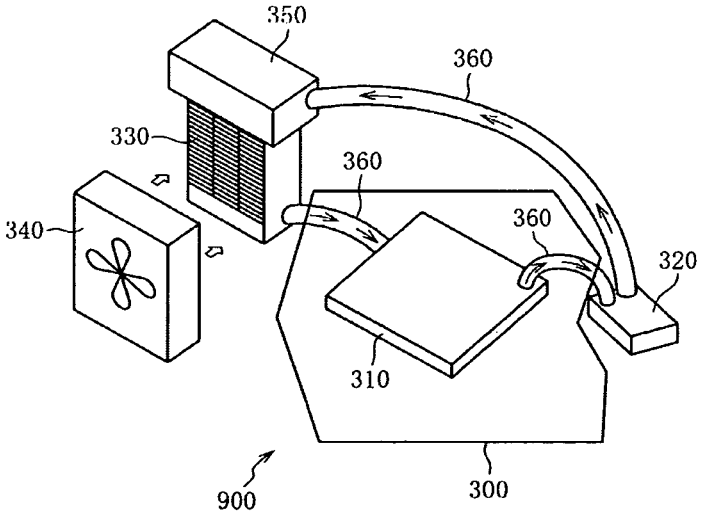
FIG. 12 is a schematic diagram illustrating the configuration of a general liquid-cooling-type cooling device.

Exemplary embodiments of the present invention have been described above; however, the present invention is not limited to the embodiments described above, and can be modified in various manners without departing from the scope of the invention. For instance, the embodiments described above are each configured to cool one of the four developing devices 4 provided in the process units 1Y, 1C, 1M, and 1Bk; however, as shown in FIG. 11, the heat absorbing unit 31 may be arranged in each of the developing devices 4. Although the piping 36 connects the heat absorbing units 31 in series in the example shown in FIG. 11, alternatively, the piping 36 may connect the heat absorbing units 31 in parallel (not shown). Further alternatively, a configuration in which circulatory paths of the heat absorbing units 31 are independent from one another, and each of the heat absorbing unit 31 includes the heat radiating unit 30, the pump 32, the tank 35, and the like (not shown) may be employed. It is also possible to set, in addition to the developing device, the scanning device, the photosensitive element, the fixing device, toner, and the like as portions to be cooled.

Meanwhile, the embodiments have been described by way of an example where devices or members including liquid-contacting metal portions are the heat absorbing unit 31, the radiator 33, the pump 32, and the metal pipes 37; however, application to a configuration where the tank 35 and/or another device or a member includes a liquid-contacting metal portion can be similarly made.

Meanwhile, an image forming apparatus, on which the cooling device according to the present invention is mounted, is not limited to a tandem, four-color image forming apparatus of an electrophotographic type, in which such four process units as those shown in FIG. 4 are arranged side by side. The cooling device can be mounted on a monochrome image forming apparatus that uses only one color, a color image forming apparatus that uses five or more colors, a copier apparatus, a printing apparatus, a facsimile apparatus, an multifunction peripheral having two or more functions of these apparatuses, other electronic equipment, or the like. Note that the process units may be in a vertical arrangement; arrangement of the intermediate transfer belt, the transfer device, the fixing device, and the like can also be appropriately changed. Note that arrangement of the cooling device can also be changed appropriately.

The present invention will be more specifically explained by way of Examples below; however, the invention is not limited by these Examples.

Example 1

The configuration of the first embodiment shown in FIG. 2 was adopted by Example 1.

In Example 1, a copper block of 30×330×20 mm, in which an U-shaped channel of ϕ6 is defined, was used as the heat absorbing unit 31. As the heat radiating unit 30, three pieces of the aluminum corrugate type radiator 33 were arranged in series. Each piece of an aluminum corrugated type radiator 33 had a 120 mm×120 mm square shape and had the thickness of 20 mm. A square axial fan (air velocity: 2.3 m/s), 120 mm each side, that was identical in size with the radiator 33 Was used as the fan 34. A piston-type micropump with a shutoff head of 25 kPa and including a liquid-contacting part, at which the micropump contacts the coolant, made of resin Was used as the pump 32. A resin tank with 900 mL capacity Was used as the tank 35. Aluminum pipes were used as the metal pipes 37. In Example 1, rubber tubes made of a mixture of butyl rubber and ethylene propylene rubber (EPDM) were used in lieu of the resin tubes 38. As the coolant, antifreeze that contained propylene glycol as the main ingredient and contained rust preventive, and met a requirement of lowering the freezing point to −30° C. was used.

With the configuration described above and using toner having a softening temperature that starts softening at 45° C., color duplex printing is continuously performed at a rate of 75 sheets per minute for 3 hours at a room temperature of 32° C. Peak temperatures, of toners of the colors, or more specifically, yellow, cyan, magenta, and black, in the developing devices are 42° C., 42° C., 43° C., and 43° C., respectively; thus, the toner temperature of any one of the colors is lower than the softening temperature at which the toner starts softening. As a result, an image with white stripes that can be formed due to toner deposition when the temperature of toner reaches the softening temperature at which the toner starts softening or higher was not formed. Furthermore, neither production of an anomalous image resulting from electrical noise nor leakage of the coolant was not occurred. Inspection of inner surfaces of the radiator 33 having a highest ionization tendency and thinnest structure was performed by removing and disassembling the radiator 33 to find that no corrosion or the like has occurred.

Example 2

In Example 2, an aluminum block was used as the heat absorbing unit 31 rather than the copper block that was used in Example 1. Every one of the aluminum heat absorbing unit 31, the radiator 33 made of aluminum, and the pipes made of aluminum is grounded. Obtained as a result of a similar test to that of Example 1 was that a highest one of peak temperatures of the toners in the developing devices is 43.5° C. Thus, the toner temperature was lower than 45° C., which is the softening temperature at which the toner starts softening. No corrosion was found neither in the aluminum radiator 33.

As described above, according to the present invention, galvanic corrosion of all or a part of liquid-contacting metal portions in the cooling device can be prevented. Accordingly, an influence of fluid leakage caused by galvanic corrosion of a liquid-contacting metal portion can be prevented or lessened. Furthermore, according to the present invention, electrostatic charge on all or a part of the liquid-contacting metal portions can be prevented. Accordingly, an influence on the surroundings due to electrostatic charge on the liquid-contacting metal portion can be prevented or lessened. In particular, in a case in which a charging unit of a corona discharge type or a proximate discharge type is used as the charging unit that charges the photosensitive element, ions are suspended around the image forming device, and hence the insulated metal portions are placed in an electrostatic-prone environment. Therefore, the configuration according to the present invention is preferably applied to such a case. As described above, according to the present invention, both prevention against galvanic corrosion of liquid-contacting metal portions and prevention against electrostatic charge can be achieved, and hence an image forming apparatus and the like that are highly reliable can be provided.

Furthermore, according to one embodiment of the prevent invention, even in a case that a plurality of liquid-contacting metal portions are made of different kinds of metal materials, each liquid-contacting metal portion is electrically insulated from each other. Therefore, no electrical current flows in spite of standard electrode potential difference between different kinds of metal materials. It results in no occurrence of galvanic corrosion. Thereby, the corrosion of the liquid-contacting metal portions can be prevented and the leakage of the coolant due to the metal corrosion can be also prevented. Therefore, the cooling capacity can be kept during long period. Furthermore, at least one of the liquid-contacting metal portions is grounded, the grounded part of the liquid-contacting metal portions has no charge due to static electricity or the like. Thereby, the bad influence of the electrostatic charge of the liquid-contacting metal portions can be prevented or reduced.

According to one embodiment of the present invention, the liquid-contacting metal portions disposed in the vicinity of a device or member to be protected from bad influence has no electrostatic charge. Thus, the bad influence of the electrostatic charge to the device or member can be effectively reduced.

According to one embodiment of the present invention, even if an electrical noise is arisen due to the electrostatic charge of the liquid-contact metal portions which is not grounded, the conductive shielding member acts as a shield so that the device or member to be protected from the bad influence of the electrostatic charge can be protected from the electrical noise.

According to one embodiment of the present invention, even if an electrical noise is arisen due to the electrostatic charge of the liquid-contact metal portions which is not grounded, the electrical noise from the liquid-contacting metal portions can be shield by the side plate or the like of the housing, since the electrostatically charged liquid-contacting metal portions are disposed in a housing different from a housing which accommodates therein the device or member to be protected from the bad influence of the electrostatic charge. Furthermore, the electrostatically charged liquid-contacting metal portions are disposed at a distance from the device or member to be protected from the bad influence of the electrostatic charge. Thus, the former and the latter are spatially blocked. Therefore, the bad influence of the electrostatic charge to the device or member can be further reduced.

Since the plurality of liquid-contacting metal portions are grounded, each of the liquid-contacting metal portions is not electrostatically charged. Thus, the bad influence due to the electrostatic charge of the liquid-contacting metal portions can be prevented. Furthermore, in one embodiment of the present invention, each liquid-contacting metal portion is grounded. That is, each liquid-contacting metal portion is electrically connected to each other. In other words, a electric conductive path is established among each liquid-contacting metal portion. Even in that case, according to the present invention, the galvanic corrosion does not occur due to the standard electrode potential difference among the liquid-contacting metal portions, since each liquid-contacting metal portion is made of a same kind of metal material. Thus, the corrosion of the liquid-contacting metal portions can be prevented, and the leakage of the coolant due to the corrosion can be prevented. Therefore, the cooling capacity can be kept during a long period. Furthermore, it is possible to avoid an adverse effect due to the adhesion of the leaked coolant to a device or member surrounding the cooling device.

According to one embodiment of the present invention, a plurality of liquid-contacting metal portions are grounded, so that each liquid-contacting metal portion is not electrostatically charged, and thus the bad influence of the electrostatic charge of the liquid-contacting metal portions can be avoided. However, in one embodiment of the invention, each liquid-contacting metal portion is not made of a same kind of metal material. In that case, the galvanic corrosion may occur. Nevertheless, the liquid-contacting metal portion, which is disposed in the vicinity of the device or member to be protected from the adhesion of the coolant, is made of a metal material having an ionization tendency lower than that of other part of the liquid-contacting metal portions, so that the liquid-contacting metal portion having the small ionization tendency cause no galvanic corrosion. On the other hand, the other part of the liquid-contacting metal portions having the high ionization tendency may cause the galvanic corrosion. Even in a case that the galvanic corrosion occurs, the point where the corrosion occurs is not in the vicinity of the device or member to be protected from the adhesion of the coolant. Thus, an adverse effect of the leakage due to the corrosion hardly arises. In this aspect, the flexibility in designing apparatus, device, unit, member and the like advantageously increases, since there is no need to use a same kind of metal material to make each liquid-contacting metal material.

According to one embodiment of the present invention, even in a case that the galvanic corrosion of the liquid-contacting metal portions made of metal material having a high ionization tendency induces the leakage of the coolant, the partition member can prevent the leaked coolant from intruding to the device or member to be protected from the adhesion of the coolant. Thereby, such a device or member can be protected.

According to one embodiment of the present invention, even in a case that the galvanic corrosion of the liquid-contacting metal portions made of metal material having a high ionization tendency induces the leakage of the coolant, the intrusion of the leaked coolant to the device or member to be protected from the adhesion of the coolant can be prevented, since the liquid-contacting metal portion(s) where the leakage of the coolant occurs is/are disposed in the housing different from the housing which accommodates therein the device or member to be protected from the adhesion of the coolant.

According to one embodiment of the present invention, since the coolant leaked from the liquid-contacting metal portions can be accommodated in the leaked-fluid container, the leaked coolant can be prevented from intruding and adhering to the device or member to be protected from the adhesion of the coolant.

According to one embodiment of the present invention, since the leakage from the liquid-contacting metal portions can be detected by the fluid-leak detector, the leaked coolant can be prevented from adhering the device or member to be protected from the adhesion of the coolant. Thereby, the reliability can be increased.

The image forming apparatus according to one embodiment of the present invention includes at least one characteristic feature of the above mentioned cooling device. Therefore, the same effect of these cooling devices can be obtained also in the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-cooling-type cooling device comprising:
- a circulatory path for coolant that cools a temperature rise portion;
- a heat absorbing unit that absorbs a heat from the temperature rise portion by the coolant;
- a heat radiating unit that radiates the heat from the coolant;
- a pump that circulates the coolant; and
- a plurality of liquid-contacting metal portions that comes into contact with the coolant, each of the liquid-contacting metal portions being made of a metal material, wherein
  - each of the liquid-contacting metal portions is grounded, and
  - a part of the liquid-contacting metal portions, the part being arranged in the vicinity of a device or member to be protected from an adhesion of the coolant, is made of a metal material of which ionization tendency is lower than an ionization tendency of another part of the liquid-contacting metal portions.

2. The cooling device according to claim 1, further comprising:
- a partition member that is arranged between: the another part of the liquid-contacting metal portions made of a metal material of which ionization tendency is higher than the ionization tendency of the part of the liquid-contacting metal portions being arranged in the vicinity of the device or member to be protected from the adhesion of the coolant; and the device or member to be protected from the adhesion of the coolant, the partition member preventing the adhesion of the coolant to the device or member.

3. The cooling device according to claim 1, wherein the other part of the liquid-contacting metal portions made of a metal material having a higher ionization tendency is accommodated in a first housing different from a second housing accommodating therein the device or member to be protected from the adhesion of the coolant.

4. The cooling device according to claim 1, further comprising:
- a leaked-fluid container that holds the coolant leaked from the liquid-contacting metal portions.

5. The cooling device according to claim 1, further comprising:
- a fluid-leak detector that detects leakage of the coolant from the liquid-contacting metal portions.

6. An image forming apparatus comprising:
- at least one image processing device; and
- a liquid-cooling-type cooling device configured to dissipate heat produced by the image processing device, the cooling device including,
  - a circulatory path for coolant that cools a temperature rise portion;
  - a heat absorbing unit that absorbs a heat from the temperature rise portion by the coolant;
  - a heat radiating unit that radiates the heat from the coolant;
  - a pump that circulates the coolant; and
  - a plurality of liquid-contacting metal portions that comes into contact with the coolant, each of the liquid-contacting metal portions being made of a metal material, wherein each of the liquid-contacting metal portions is grounded, and a part of the liquid-contacting metal portions, the part being arranged in the vicinity of a device or member to be protected from an adhesion of the coolant, is made of a metal material of which ionization tendency is lower than an ionization tendency of another part of the liquid-contacting metal portions.

* * * * *